United States Patent [19]

Lax et al.

[11] Patent Number: 4,865,208

[45] Date of Patent: Sep. 12, 1989

[54] SUPPORT DEVICE FOR HOLDING A BOTTLE IN SUSPENDED RELATIONSHIP

[75] Inventors: Harold Lax, Old Westbury; Michael Lax, Oyster Bay Cove, both of N.Y.

[73] Assignee: Autronic Plastics, Inc., Westbury, N.Y.

[21] Appl. No.: 180,308

[22] Filed: Apr. 12, 1988

[51] Int. Cl.[4] ..... B65D 23/10

[52] U.S. Cl. ..... 215/100 A; 220/85 H:94 R; 294/27.1; 294/31.2; 294/33

[58] Field of Search ..... 215/100 R, 100 A; 220/85 H, 94 R; 294/27.1, 31.2, 33

[56] References Cited

U.S. PATENT DOCUMENTS

| | | | |
|---|---|---|---|
| 654,056 | 7/1900 | Duffy | 294/31.2 |
| 2,598,747 | 6/1952 | Alex | 215/100 A X |
| 3,191,819 | 6/1965 | Smith | 220/94 R X |
| 4,379,578 | 4/1983 | Schuler | 294/31.2 |
| 4,456,135 | 6/1984 | Beekes | 220/94 R X |
| 4,660,876 | 4/1987 | Weldin et al. | 294/31.2 X |
| 4,773,549 | 9/1988 | Avraham | 215/100 A |

FOREIGN PATENT DOCUMENTS

| | | | |
|---|---|---|---|
| 8302101 | 6/1983 | PCT Int'l Appl. | 215/100 A |
| 919799 | 2/1963 | United Kingdom | 215/100 A |
| 1341481 | 12/1983 | United Kingdom | 215/100 A |

*Primary Examiner*—Sue A. Weaver

*Attorney, Agent, or Firm*—Roberts, Spiecens & Cohen

[57] ABSTRACT

A bottle support is provided to hold a bottle in suspended relationship and in such a manner as to be locked to the bottle so that the contents of the bottle can be poured without detachment occurring between the bottle and the support. To enable a mounting of the support atop the bottle, the support is provided with a keyhole-like opening having a first section which is an enlarged lobe which permits the penetration of the neck of the bottle through opening in the support and a second section which is smaller and permits engaging beneath an annular rib which is located on the neck of the bottle. To permit a tilting of the skirt of the support as the support is being mounted on the bottle, the skirt is provided with a cut away portion adjacent the handle which is provided on the skirt.

9 Claims, 4 Drawing Sheets

FIG. 1
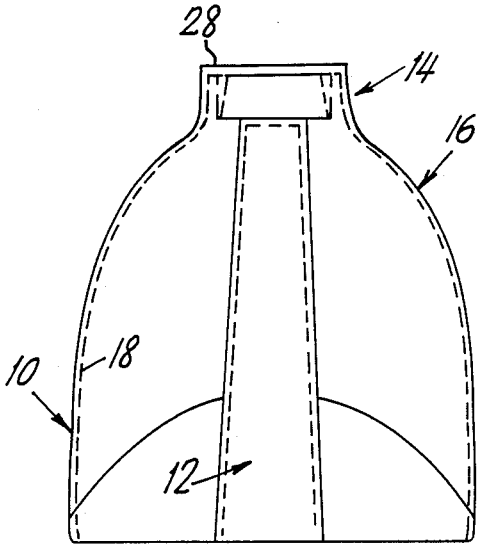
FIG. 2
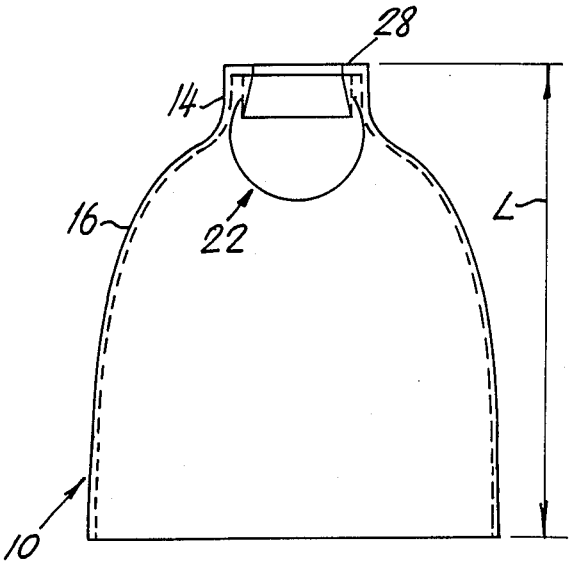
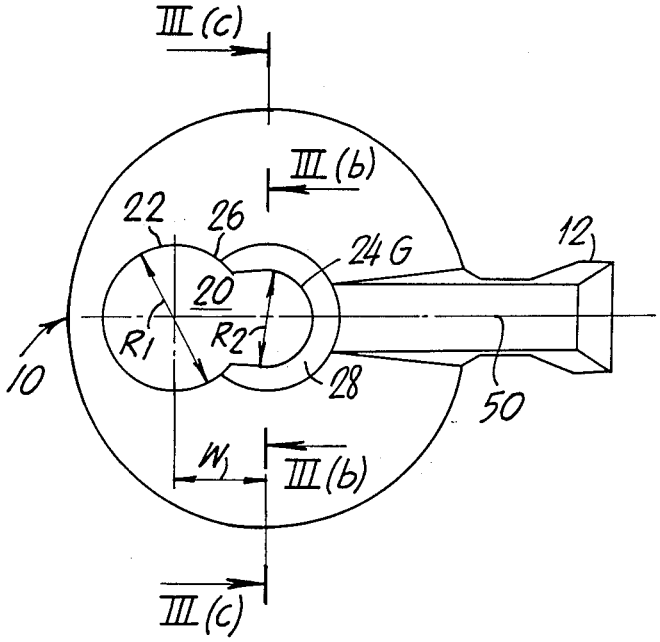
FIG. 3(a)
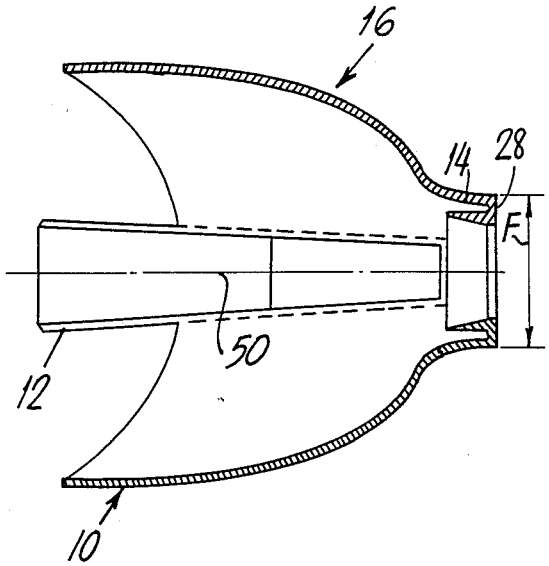
FIG. 3(c)

SUPPORT DEVICE FOR HOLDING A BOTTLE IN SUSPENDED RELATIONSHIP

FIELD OF THE INVENTION

This invention relates to devices for manipulating bottles and more particularly to devices for holding bottles in suspended relationship while permitting the emptying of the contents thereof with optimum facility.

BACKGROUND

There are currently being employed bottles manufactured of relatively flexible plastics such as P.E.T. (polyethylene terephthalate). While the contents of these bottles remain fully stored within the same, the bottles are relatively rigid and shape maintaining. However as the contents are emptied from such bottles and replaced by air, these bottles become easily deformable and thus make manual grasping of the same much more difficult. In fact this deformation may increase to such a degree that such bottles will frequently slip from the grasp of the user, thus causing the spilling of the remainder of the contents and other like inconveniences.

Some bottle holders are known such as, for example, that shown in U.S. Pat. No. 2,961,112 and that shown in Des. Pat. 184,673. These holders and other similar holders support the bottles from the bottoms thereof, and in this respect differ markedly from the type of holder provided in accordance with the invention and to be disclosed in detail hereinbelow.

The bottom supporting type of bottle holder has the disadvantage relative to the top engaging type of holder in that the weight of the liquid contents of a bottle tend to move towards the top of the bottle during a pouring operation. This tends to dislodge the bottle from a bottom engaging type of holder, whereas such movement of the liquid contents of a bottle tends to move the bottle more snugly into engagement with the top engaging type of holder as will become apparent hereinbelow.

SUMMARY OF INVENTION

It is an object of the invention to provide improved bottle support for various types of bottles such as, for example, soda bottles and other types bottles containing liquids such as juices and the like.

It is another object of the invention to provide a top engaging type of bottle holder which reinforces the structure of the bottle which is being supported and which is particularly useful in connection with flexible types of bottles such as those manufactured from P.E.T.

Still another object of the invention is to provide an improved bottle holder which is readily engaged and disengaged from an associated bottle, and which accordingly is easily moved from bottle to bottle when the bottle contents are exhausted and a new bottle is employed.

In achieving the above and other objects and advantages of the invention, there is provided in accordance with the invention a bottle supporting device for supporting a bottle which includes a body, a neck atop said body, and an annular rib encircling said neck. The device according to the invention comprises a skirt adapted for encircling the body of the bottle, the skirt having a shape adapted to engage the bottle at the top thereof and being further adapted to accommodate the above-mentioned neck. Furthermore, there is provided a handle on the skirt to permit the manipulation of the bottle. According to a feature of the invention the skirt is provided with a keyhole-like opening (i.e., adjacent holes of unequal size opening into one another) to permit the penetration of the neck and above-mentioned annular rib and to secure the skirt beneath the rib.

According to a further feature of the invention the above mentioned keyhole shaped opening includes first and second connected sections, the first section being larger than the second section to permit penetration of the annular rib as the device is mounted on the top of the bottle, said second section being small enough to prevent passage of the rib and thus to prevent disengagement of the skirt from the bottle.

As will be shown in the detailed description which follows hereinbelow, the above-mentioned skirt and second section of the opening are concentric. The first section of the opening is displaced from the second section and constitutes an enlarged lobe. The handle and first and second sections are rectilinearly aligned. The skirt moreover has a cut-away portion so that the skirt can be tilted while being mounted on the bottle whereby the neck and annular rib pass through the above-mentioned first section of the opening.

A significant feature of a preferred embodiment of the invention is an inwardly directed rib section provided on the skirt and at least partly defining the above-mentioned second section. This rib is engageable beneath the annular rib on the neck of the bottle.

According to the invention, the bottle is of relatively flexible material and the skirt and handle are of a material which is relatively rigid with respect to the material of the bottle. Moreover, the bottle has a fixed height and the above-mentioned skirt is of a shape which is adapted to extend along at least $\frac{1}{4}$ of the height at a position opposite the handle. As a result, it becomes possible to support the bottle, during the pouring out of the contents thereof, with maximum effectiveness.

The bottles which are supported in accordance with the invention generally have liquid contents of a determinable weight. Accordingly, the skirt and handle are designed to be of a material having sufficient strength to support the bottle in suspended relationship. It will be seen that the above-mentioned handle extends beyond the skirt at the cut-away portion. It will also be seen that the skirt and handle are monolithic and are of a plastic having a tensile strength in the order of magnitude of 3,500 p.s.i. Such a material is a copolymer polypropylene with a specific example being given hereinbelow. The material from which the support of the invention is made should be adapted to retain a flexural modulus to provide elasticity under refrigerated conditions.

The above and other objects, features and advantages of the invention will be found in the detailed description which follows hereinbelow as illustrated in the accompanying drawing.

BRIEF DESCRIPTION OF DRAWING

In the drawing;

FIG. 1 is a view of the bottle support of the invention from the handle side;

FIG. 2 is a view of the bottle support of the invention from the side opposite that of FIG. 1;

FIG. 3(*b*) is a sectional view along line III(*b*)—III(*b*) of FIG. 3(*a*);

FIG. 3(*c*) is a sectional view along line III(*c*)—III(*c*) of FIG. 3(*a*);

DETAILED DESCRIPTION

Figure 3B:
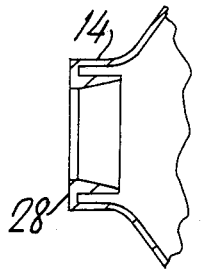
FIG. 3(*a*) is a top view of the bottle support of FIGS. 1 and 2.

One specific purpose for which the bottle support of the invention is suitable is as a soda bottle holder for one, two, and three litre P.E.T. soda bottles. The support or holder of the invention provides the consumer with an adaptable handle which is easily installed on any bottle of the above-noted type. The invention is, however, not limited to soda bottles of the above indicated type since, as will be seen, the invention is readily adaptable to various types of bottles and other containers without departing from the scope of the invention.

When applied, the soda bottle support of the invention will facilitate one-hand lifting of a bottle and the pouring out of the contents thereof. The structure of the invention provides excellent handling control and, moreover, the structure of the invention will be reusable and very durable. The product may be injection molded with F.D.A. approved polypropylene or polystyrene plastic resin. A variety of colors and finishes may be employed. For example, the holder or support of the invention may be black and provided with a textured sand blast finish.

It will be noted that the structure of the invention permits bulk packing with the holders or supports of the invention being readily nestible one inside of the other for facilitating shelf storage.

Referring next to FIGS. 1–4, it is seen that a bottle support of the invention comprises a skirt 10 and a handle 12. The skirt 10 is a shaped wall of a generally circular cross-section to conform to the circular cross-section of the bottle to which it is to be attached. The skirt generally also has a shape which is configured to conform to the shape of the bottle. Thus, the skirt 10 has a neck portion 14 and a shoulder portion 16 which engages the neck portion with the body portion 18 which is of an inner diameter corresponding to the outer diameter of the bottle with which the support is to be associated.

As one of the features of the invention, the structure of the invention is provided with a keyhole-like opening indicated at 20. The keyhole-like opening 20 includes a first section 22 and a second section 24 connected therewith. The first section 22 is an enlarged lobe having a diameter which permits the passage of the neck of the bottle with which engagement is to be made as well as to permit the passage of an annular ring or rib which is usually located on the neck of the bottle. For purposes of convenience and with the taking of a slight liberty the radius of this lobe or section is indicated at R1. The second section 24 is of a smaller diameter or radius. This radius is indicated at R2. R1 exceeds R2 by at least about 25%. There can be a small connecting section as is indicated at 26, as it is required in accordance with the invention that the sections 22 and 24 be connected for reasons which will become apparent hereinafter.

The skirt 10 is provided with a partial snap rib indicated at 28. The purpose of this rib will also be made apparent hereinbelow. It will also be observed that the skirt is provided with a cut-away portion 30. Thus, the skirt has its minimum height at the position indicated at 32 and has its maximum height at a position indicated at 34. It will be noted also that the height of the skirt 10 at the position indicated at 36 is substantially greater than at position 32. The purpose of the cut-away portion is to permit the skirt and its axis 38 to be tilted relative to the axis of the bottle on which the support is to be mounted. This will serve a purpose to be explained hereinbelow.

The edge which connects 34 to 36 enables an effective hold to be achieved relative to the bottle which is to be supported in vertical and inclined and horizontal attitudes of such bottle.

The handle 12 of the bottle support of the invention has a rounded section indicated at 46 merging into a supporting section indicated at 48. The handle 12 is monolithic with the skirt 10 and the one piece structure is fabricated of a suitable plastic having appropriate refrigerated-condition characteristics. Polypropylene or polystyrene may be employed as has already been indicated and, in particular, there may be employed a copolymer polypropylene having, for example, a tensile strength at yield of 3,500 p.s.i. and an elongation at yield of 13%. The material may have preferably a notched Izod impact 1/8th inch specification of 1.9 ft. lbs./in. The copolymer shall preferably be FDA approved since it will normally be used with foodstuffs. Such a copolymer may be identified as Pro-fax SB 751 available through Himont USA Inc. of Wilmington, Del. This material can be injection molded and will have the properties required to satisfy refrigeration conditions and will have a flexural modulus to provide elasticity and ductility for the snap lock feature of the invention as will be seen. It also will provide a suitable range of application to a variety of sizes.

The center line 50 will also indicate that the handle 12 and sections 22 and 24 of the keyhole-like opening 20 are rectilinearly aligned. The axis 38 of the structure is also the axis of section 24. Thus section 24 and the skirt 10 are concentric. The first section 22 is offset there from by an amount indicated at W. For a skirt having a diameter of for example 4.657 inches the displacement W may be for example 1.050 inches.

Other dimensions which may be noted include the thickness T of the rib 28. This may be for example a dimension in the order of magnitude of 0.112 inches.

Figure 4:
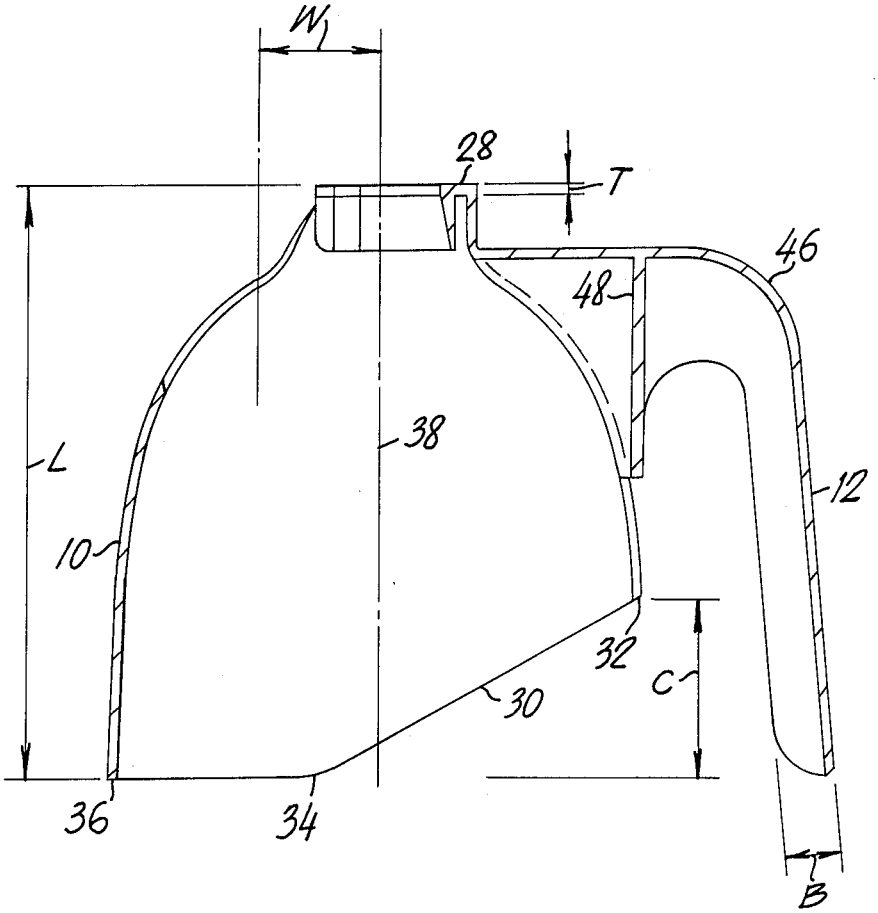
FIG. 4 is a sectional view from a side taken perpendicularly to the views of FIGS. 1 and 2.

As will also be seen in the drawing the handle may have an effective thickness, for example and as shown at B in FIG. 4, of 0.500 inches. It will be noted that the handle extends a dimension C from and beyond the point 32 of the skirt 10 which is equal for example to about 1.550 inches.

The diameter of the neck portion of the skirt 10 is indicated at F in FIG. 3(*c*) and is, in one example for a two liter bottle, equal to about 1.658 inches. The diameter of the second section 24 is indicated at G and may be for example 1.055 inches with the total height of the skirt being indicated at L and being equal, for example, to about 5.191 inches.

Figure 5:
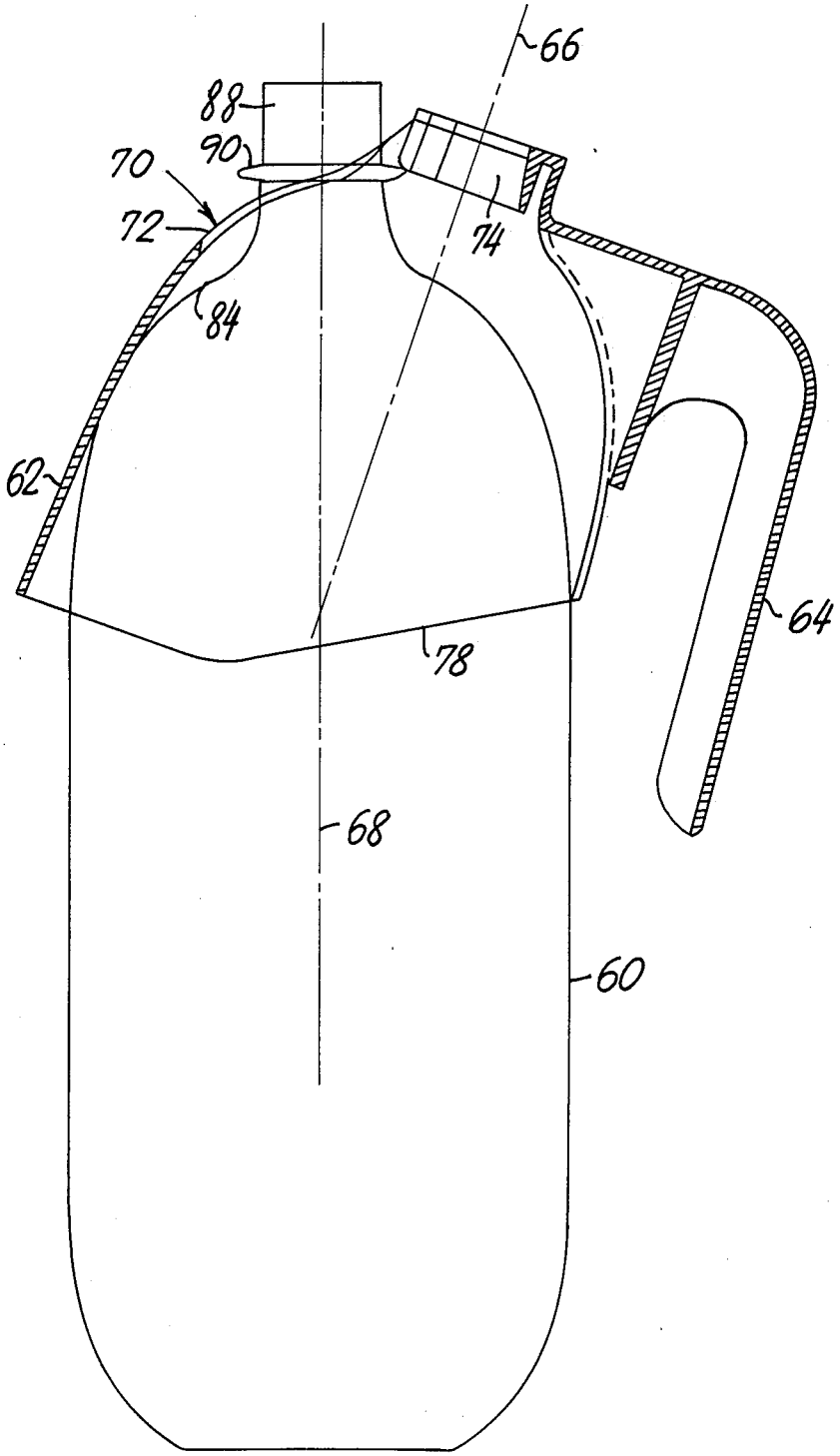
FIG. 5 is a diagrammatic view of a version of the invention illustrating how the same is engaged with a P.E.T. soda bottle.
Figure 6:
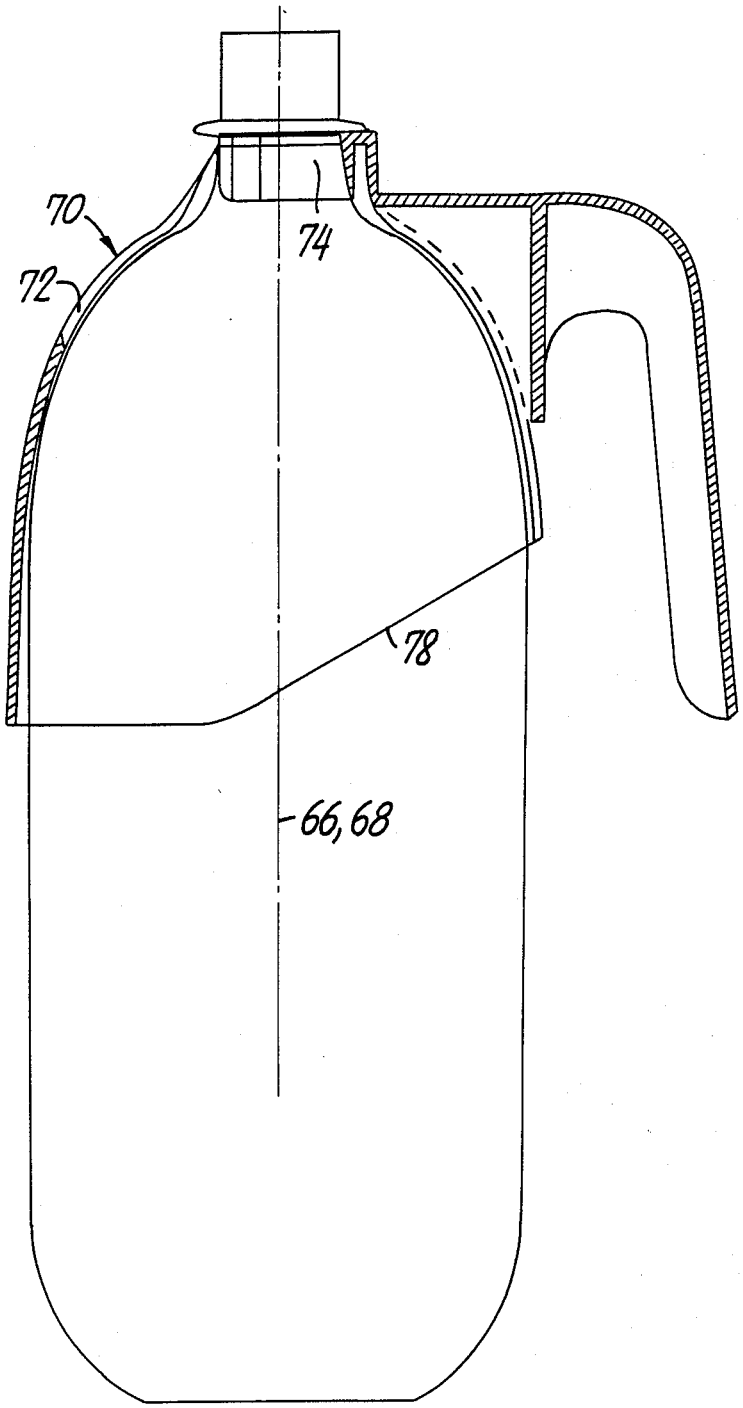
FIG. 6 is a view corresponding to that of FIG. 5 but illustrating the bottle support of the invention in seated disposition.

A version of the support of the invention appears in FIGS. 5 and 6 wherein also appears a bottle 60 which may, for example, be a 1, 2, or 3 liter bottle in which the contents may be a carbonated beverage or soda. The skirt is indicated at 62 constituting the handle 64 of a bottle support provided in accordance with the invention. The axis of the support is indicated in FIG. 5 at 66. If the axis 66 were to be aligned with the axis 68 of the bottle and the support were to be moved vertically downward it would not be possible to place the support of the invention on the bottle. To avoid this problem, the support in Figs. 5 and 6 is provided with a keyhole-like opening 70 such as has been described hereinabove as including a first section 72 and a second section 74.

Since the support is provided with a cut-away portion 78 it is possible by manipulating the handle 64 to tilt the axis 66 to a position relative to the axis 68 as shown in FIG. 5. This brings the section 72 of the keyhole-like opening 70 into vertical registration with the neck 88 of the bottle which may then penetrate along with the annular rib 90 through the first section 72 so that the skirt 62 comes to bear against the shoulder section of the bottle. The bottle support of the invention is then manipulated by means of the handle 64 so as to bring the axes 66 and 68 into coincidence (FIG. 6) whereupon the section 74 is brought into concentric relationship with the axes 66 and 68 which now coincide also with the axis of the skirt 62. The support is brought into engagement under the annular rib or ring 90 of the bottle 60 thereby firmly engaging the support with the bottle 60. The support is now trapped between the annular ring 90 and the shoulder portion 84 of the bottle and will not become dislodged therefrom until action is taken through manipulation of the handle 64 to displace the bottle support into the tilted posture illustrated in FIG. 5.

A detachment of the bottle support of the invention from the associated bottle will not accidentally occur. First of all, when the bottle is in its vertical position, the bottle support of the invention is entrapped between the ring 90 and the shoulder 84 as mentioned hereinabove. When the bottle is tilted into horizontal attitude for purposes of pouring out all or a part of the liquid contents thereof, the fluid within the bottle will move into the shoulder portion of the bottle and will tend to hold the bottle more firmly engaged within the support. Only a conscious and intentional effort to dislodge the support from the bottle will result in an accomplishment of this purpose. Thus the invention provides for a firmly engageable support which is capable of holding a bottle in suspended relationship and is further capable of enabling the bottle to be handled in various postures thereof without the bottle support of the invention becoming detached. The bottle is as has been noted possibly of a relatively flexible material. On the contrary, the skirt and handle are of a material which is relatively rigid relative to the material of the bottle. Thus the skirt and indeed the bottle support of the invention are adapted to maintain the conformation of the associated bottle and to tend to prevent the same from becoming deformed. In any event the bottle support of the invention constitutes a handle by means of which the consumer may readily manipulate the associated bottle without fear of the bottle's slipping from the hand of the consumer. The bottle has generally a fixed height and the skirt of the invention is of a shape which is adapted to extend along at least about ¼ of this height at a position opposite the handle. This permits supporting the bottle during the pouring out of the contents thereof. The bottle also has contents which will be of a determinable weight. The skirt and handle are generally and preferably of a material having sufficient strength to support the bottle in suspended relationship. For bottles of the type indicated above, the wall thickness of the skirt and other portions of the bottle support of the invention may be in the order of magnitude of 0.078 inches. This dimension is variable within wide limits within the scope of the invention.

There will now be obvious to those skilled in the art many modifications and variations of the structure set forth hereinabove. These modifications and variations will not depart from the scope of the invention if defined by the following claims.

We claim:

1. A bottle supporting device for supporting a bottle which includes a body, a neck atop said body, a shoulder connecting said neck to said body, and an annular rib encircling said neck and spaced from said shoulder, said device comprising a skirt adapted for encircling said body, and a handle on said skirt to permit the manipulation of said bottle, said skirt being a shaped wall provided with a keyhole-like opening to permit the penetration of said neck and annular rib and including a portion to be entrapped between said rib and shoulder of said bottle to secure said skirt beneath said rib, said opening including first and second connected sections, said first section being larger than said second section, to permit the passage of the annular rib as the device is mounted atop said bottle, said second section being small enough to prevent passage of said rib there through and thus to prevent disengagement of the skirt from the bottle, the skirt and second section being concentric, the first section being displaced from the second section and said handle and first and second sections being rectilinearly aligned, the skirt having a cut-away portion so that the skirt can be tilted while being mounted on the bottle whereby the neck and annular rib can pass through said first section of said opening, said skirt being of a shape which is adapted to extend along and lie against at least about one-quarter of said body adjacent the shoulder and at a position opposite said handle whereby to support said bottle and prevent deformation thereof during a pouring out of contents of the bottle, the tilting of the skirt enabling said first and second sections of the keyhole-like opening to be brought respectively into registration with the neck of said bottle.

2. A device as claimed in claim 1 wherein said skirt includes a rib section at least partly defining said second section and engageable beneath said annular rib.

3. A device as claimed in claim 1 wherein said bottle is of relatively flexible material and said skirt and handle are of a material which is relatively rigid respect to the material of the bottle.

4. A device as claimed in claim 1 wherein said bottle has liquid contents of a determinable weight and said skirt and handle are of a material having sufficient strength to support said bottle in suspended relationship.

5. A device as claimed in claim 1 wherein said handle extends beyond said skirt at said cut-away portion.

6. A device as claimed in claim 1 wherein said skirt and handle are monolithic.

7. A device as claimed in claim 1 wherein said skirt is of a plastic having a tensile strength of 3500 p.s.i.

8. A device as claimed in claim 7 wherein said skirt is of a plastic adapted to retain a flexural modulus to provide elasticity under refrigerated conditions.

9. A device as claimed in claim 1 wherein said skirt includes a shoulder portion conforming at least substantially to the shoulder of the bottle.

* * * * *